US010189548B1

(12) United States Patent
Moore

(10) Patent No.: US 10,189,548 B1
(45) Date of Patent: Jan. 29, 2019

(54) LADDER WITH WATER SENSING LIGHTS

(71) Applicant: Brunswick Corporation, Lake Forest, IL (US)

(72) Inventor: Todd W. Moore, Rosemount, MN (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/716,724

(22) Filed: Sep. 27, 2017

Related U.S. Application Data

(60) Provisional application No. 62/403,903, filed on Oct. 4, 2016.

(51) Int. Cl.
*B63B 45/04* (2006.01)
*B63B 27/14* (2006.01)

(52) U.S. Cl.
CPC ..... *B63B 27/146* (2013.01); *B63B 45/04* (2013.01)

(58) Field of Classification Search
CPC ..... B63B 27/146; B63B 45/04
See application file for complete search history.

(56) References Cited

U.S. PATENT DOCUMENTS 2,758,770 A 8/1956 Wagner
2,992,697 A 7/1961 Klages
3,169,503 A 2/1965 Lane
3,892,290 A 7/1975 Lang
3,944,024 A 3/1976 Adas
4,432,436 A * 2/1984 Suiter ..... B63B 27/14 114/343
4,456,094 A 6/1984 Brander
4,522,143 A 6/1985 Holzbaur
4,637,492 A * 1/1987 Herr ..... B63B 17/00 182/93
4,697,535 A * 10/1987 Wileman, III ..... B63B 13/02 114/183 R
5,704,447 A * 1/1998 Doyle ..... B63B 27/14 182/196
5,719,552 A 2/1998 Thompson
(Continued)

FOREIGN PATENT DOCUMENTS

WO 1982001692 A1 5/1982
WO 2015059678 A1 4/2015

OTHER PUBLICATIONS

Innovation First Labs, Inc., "Hexbug Zombie Aquabot", website, available at https://www.hexbug.com/aquabot/hexbug-zombie-aquabot-8482.html, available at least as early as Jun. 3, 2016, website last visited on Aug. 30, 2017.
(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A ladder for a boat includes a rail configured to be coupled to the boat and a rung supported by the rail. A light source is coupled to at least one of the rung and the rail. A power source provides electrical power to the light source, and a water sensor controls provision of the electrical power to the light source. The electrical power is provided to the light source and the light source is illuminated in response to the water sensor sensing water. A lighted rung for a boat ladder is also provided.

20 Claims, 6 Drawing Sheets

(56) References Cited

U.S. PATENT DOCUMENTS

| | | | | |
|---|---|---|---|---|
| 5,945,912 | A * | 8/1999 | Guldbrand | B63C 9/0005 116/210 |
| 6,237,523 | B1 | 5/2001 | Day et al. | |
| 6,386,318 | B1 * | 5/2002 | Smith | B63B 27/146 182/206 |
| 6,612,256 | B1 | 9/2003 | Martin | |
| 6,921,184 | B2 * | 7/2005 | Tufte | B60Q 1/32 362/368 |
| 7,735,457 | B2 | 6/2010 | O'Connor | |
| 8,303,145 | B2 | 11/2012 | Wilcox | |
| 8,502,464 | B2 | 8/2013 | Lakirovich et al. | |
| 8,944,865 | B1 * | 2/2015 | Krabacher | B63H 21/17 440/1 |
| 8,998,666 | B1 * | 4/2015 | Albright | B63C 9/00 340/539.13 |
| 9,067,647 | B2 | 6/2015 | Neese | |
| 9,151,484 | B1 | 10/2015 | Olsson et al. | |
| 9,205,896 | B2 | 12/2015 | Mueller | |
| 9,223,027 | B1 | 12/2015 | Albright | |
| 2001/0023659 | A1 * | 9/2001 | Nixon | B63B 27/14 114/362 |
| 2002/0052159 | A1 | 5/2002 | Eguchi | |
| 2003/0066475 | A1 | 4/2003 | Nixon | |
| 2004/0040489 | A1 | 3/2004 | Martin | |
| 2005/0141214 | A1 | 6/2005 | Fotherby | |
| 2007/0034248 | A1 * | 2/2007 | Romano | F21S 8/00 136/244 |
| 2008/0169153 | A1 | 7/2008 | O'Connor | |
| 2014/0261145 | A1 * | 9/2014 | Neese | B63B 27/146 114/362 |
| 2015/0259046 | A1 | 9/2015 | Neese | |
| 2016/0090158 | A1 * | 3/2016 | Ortwein | B63B 45/04 362/477 |
| 2018/0136027 | A1 * | 5/2018 | Demski | G01F 23/0007 |

OTHER PUBLICATIONS

Tate et al., "Marine Navigational Light Fixture Having Sub-Housing with Built-In Cutoffs," Unpublished U.S. Appl. No. 15/703,569, filed Sep. 13, 2017.

* cited by examiner

LADDER WITH WATER SENSING LIGHTS

CROSS-REFERENCE TO RELATED APPLICATION

The present application claims the benefit of U.S. Provisional Application Ser. No. 62/403,903, filed Oct. 4, 2016, which is hereby incorporated by reference herein.

FIELD

The present disclosure relates to ladders for boats or other ladders meant to be submerged in water, such as those on a dock or raft.

BACKGROUND

Ladders can be provided for boats, docks, rafts, and the like to allow boaters and swimmers to climb into and out of the water in which the ladder is at least partially submerged.

U.S. Patent Application Publication 2007/0034248 discloses a floating solar powered apparatus including a main housing with an electrically operated component, with an at least translucent portion for transmittal of sunlight into the main housing during daylight hours. It is sometimes transparent or one or more colored translucent areas or, a combination of these. The main housing is water impervious and has at least one rope attachment orifice. The electronically operated component contained within the main housing is selected from the group consisting of a detector, an alarm, a radio, a light source for illumination, and combination thereof. There is also a power supply and appropriate connections connected to the electronically operated component(s) contained within the main housing that includes at least one solar cell. The at least one solar cell is located in the at least translucent portion of the main housing. In some preferred embodiments, the at least translucent portion is transparent.

U.S. Pat. No. 9,205,896 discloses stairs that are attached under a platform and can be swung out and are distinguished in that the steps remain positionally stable horizontally when the stairs are swung out, and the bottom steps form a cover and optionally a flow body, and once the stairs are swung out, they form means for climbing in and out of the water, a seat element, function as a trim tab and damping means and, when the swinging arms are swung out further, constitute an additional platform, and the swinging ladder consists of ladder elements and can be folded by means of a cam and a bracket, and the stairs and swinging ladder as a stairway can have a handrail which can be swung out manually or automatically.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a ladder for a boat is provided. The ladder includes a rail configured to be coupled to the boat and a rung supported by the rail. A light source is coupled to at least one of the rung and the rail. A power source is configured to provide electrical power to the light source. A water sensor is configured to control provision of the electrical power to the light source. Electrical power is provided to the light source and the light source is illuminated in response to the water sensor sensing water.

In another example, a lighted rung for a boat ladder includes a main body having a first surface that faces upward when the ladder is in a use position and a second surface that faces downward when the ladder is in the use position. A light source is coupled to the main body. A power source is configured to provide electrical power to the light source, and a water sensor is configured to control provision of the electrical power to the light source. Electrical power is provided to the light source and the light source is illuminated in response to the water sensor sensing water.

BRIEF DESCRIPTION OF DRAWINGS

Examples of lighted ladder assemblies are described with reference to the following Figures. The same numbers are used throughout the Figures to reference like features and like components.

DETAILED DESCRIPTION OF DRAWINGS

In the present description, certain terms have been used for brevity, clarity and understanding. No unnecessary limitations are to be implied therefrom beyond the requirement of the prior art because such terms are used for descriptive purposes only and are intended to be broadly construed. The different assemblies described herein may be used alone or in combination with other assemblies. Various equivalents, alternatives, and modifications are possible within the scope of the claims.

Figure 1:
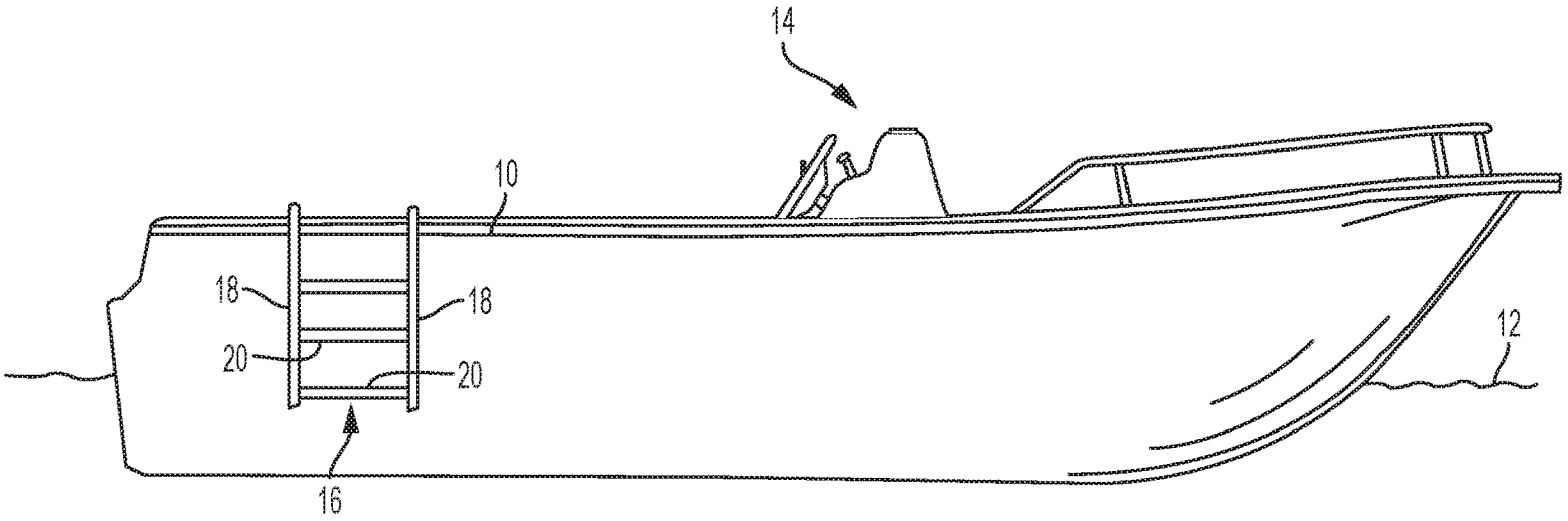
FIG. 1 is a schematic of a boat with a ladder coupled thereto.

FIG. 1 depicts a boat 10 in a body of water 12. The boat 10 includes, among other things, a helm 14 for providing commands to one or more marine propulsion devices (not shown), which can include any type of device for propelling the boat 10 in the water 12, including, but not limited to, one or more stern drives, pod drives, outboard motors, or the like.

Figure 9:
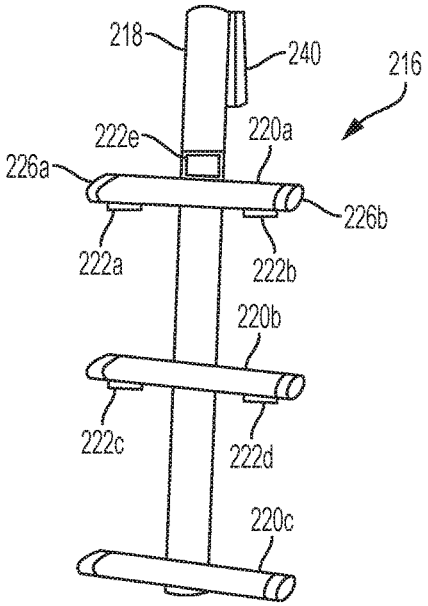
FIG. 9 illustrates a different type of lighted ladder.

The boat 10 is equipped with a ladder 16 for allowing boaters to climb into and out of the boat 10 from and to the water 12. The ladder 16 has two side rails 18 and a number of rungs 20 or steps connected on each side thereof to the rails 18. The ladder 16 is shown in its "use" position, in which the ladder 16 is oriented substantially parallel to the side of the boat 10 and the rungs 20 face upward for placement of a user's feet thereupon. The size, shape, and configuration of the rungs 20 and rails 18 can vary from that shown herein and is not limiting on the scope of the present disclosure. The ladder 16 can be a semi-permanent ladder or a removable ladder and can be foldable, retractable, telescoping, or of fixed length. The rails 18 and rungs 20 can be made of rope, plastic, and/or metal, such as aluminum or stainless steel. The ladder 16 can be a gunwale boarding ladder, a transom boarding ladder, a pontoon boarding ladder (FIG. 2), or can be specifically designed for sports and diving (FIG. 9). In other examples, the ladder 16 is not provided on a boat 10 at all, but instead can be coupled to a dock or a raft.

If one is boating in the dark, in cloudy or hazy conditions, or even if the water 12 in which one is boating is murky, it is desirable to have lights on the rails 18 and/or rungs 20 of the ladder 16 in order to aid one with placement of the one's hands and/or feet on the ladder 16. The lights can be strong enough to illuminate the outline of the rails 18 and/or rungs 20, or can be just bright enough to provide an indication of where the rails 18 and/or rungs 20 are located. In some instances, the lights can be turned on and off manually by way of a switch provided at the helm 14, on the ladder 16 itself, or elsewhere on the boat 10. In contrast, in the examples of the present disclosure, a light, a water sensor, and a power source are provided on the ladder 16 itself. When the water sensor senses water, it activates a switch that in turn causes electricity to be conducted from the power source to the light. An assembly of the light, water sensor, and power source can be integrated into the ladder 16 (e.g., into the rails 18 or rungs 20), or can be provided in a clip or strip that can be removably attached to the ladder 16. The lighted ladder 16 of the present disclosure is activated when a water sensor on the ladder 16 senses that that the ladder 16 has been at least partially submerged in the water 12, thus eliminating the need for a manually actuated switch.

Figure 2:
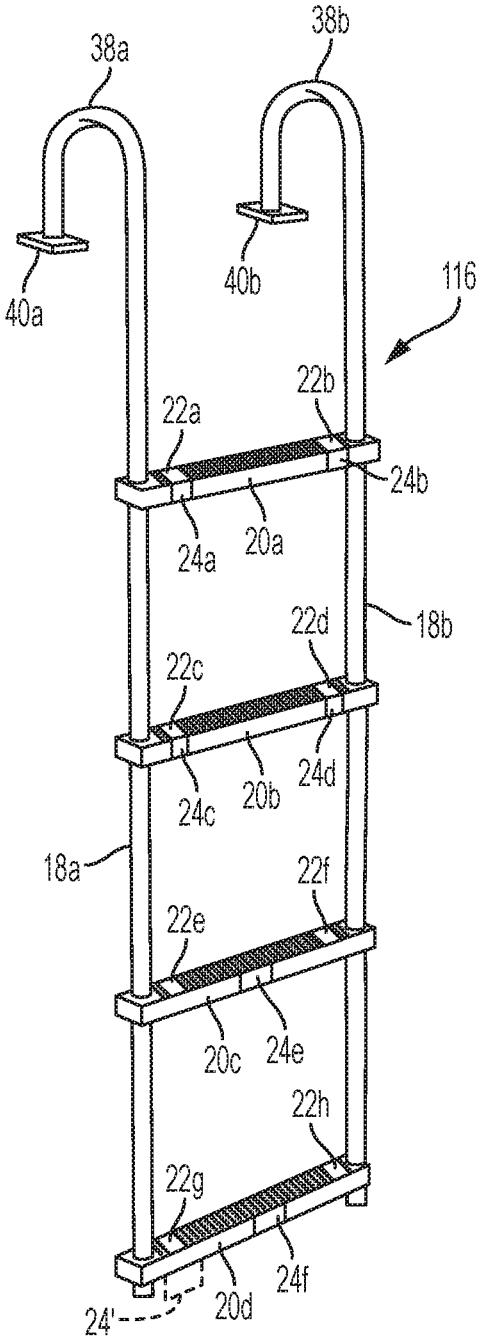
FIG. 2 is a schematic of one example of a lighted ladder.

FIG. 2 is a schematic of one example of a lighted ladder 116. In this example, each rung 20*a*, 20*b*, 20*c*, 20*d* is provided with two lights on its upper surface. The lights 22*a*-22*h* are shown herein as being flush with the upper surfaces of the rungs 20*a*-20*d*; however, it should be understood that the lights 22*a*-22*h* can instead be raised from the upper surfaces of each respective rung 20*a*-20*d* or recessed therefrom. In another example, the lights can be provided on the rails 18*a*, 18*b* instead of the rungs 20*a*-20*d*. In the example of FIG. 2, water sensors 24*a*-24*f* are provided one each of the rungs 20*a*-20*d*. The lights 22*a*-22*h* are provided with their own water sensor or with a shared water sensor on a given rung. For example, on rung 20*a*, light 22*a* is lit when water sensor 24*a* senses water, and light 22*b* is lit when water sensor 24*b* senses water. Similarly, on rung 20*b*, light 22*c* is lit when water sensor 24*c* senses water, and light 22*d* is lit when water sensor 24*d* senses water. In contrast, on rung 20*c*, both lights 22*e* and 22*f* are electrically connected to water sensor 24*e*, such that lights 22*e*, 22*f* are lit when water sensor 24*e* senses water. The same applies to rung 20*d*, where water sensor 24*f* is electrically connected to both lights 22*g* and 22*h*.

In another example, a single water sensor 24' could be provided on the lower surface of the bottom rung 20*d*. This single water sensor 24' could be electrically connected to all of the lights 22*a*-22*h* on each of the rungs 20*a*-20*d*. When the water sensor 24' senses water, all of the lights 22*a*-22*f* will be illuminated. In another example, the single water sensor 24' could be provided on one of the rails 18*a* or 18*b*; on the upper surface or side surface of the bottom rung 20*d*; or on the upper, side, or bottom surface of one of the other rungs 20*a*, 20*b*, or 20*c*.

Referring briefly to FIG. 9, note that lights could be provided on a different type of ladder 216. This ladder 216 has a single rail 218 that supports rungs 220*a*, 220*b*, 220*c*. Although lights could be provided on the top surface of the main body of each rung 220*a*-220*c*, in this example, the lights are instead provided on the bottom surface of only rungs 220*a* and 220*b*. Lights 222*a* and 222*b* are oriented and strong enough to light rung 220*b*, and lights 222*c* and 222*d* are oriented and strong enough to light rung 220*c*. Rung 220*a* may not require lighting because it is nearest the surface of the water. Alternatively, rung 220*a* may be lit by a light 222*e* coupled to rail 218. The light 222*e* could be integrated into the rail 218, or could be provided on a clip, as will be described herein below with respect to FIG. 6. In yet another example, lights could be provided on or in end caps (see 226*a*, 226*b*) at the ends of each rung. Although water sensors are not shown for each light 222*a*-222*e*, note that individual water sensors could be provided for each light 222*a*-222*e*, or one water sensor could be provided for one or more lights.

Figure 3:
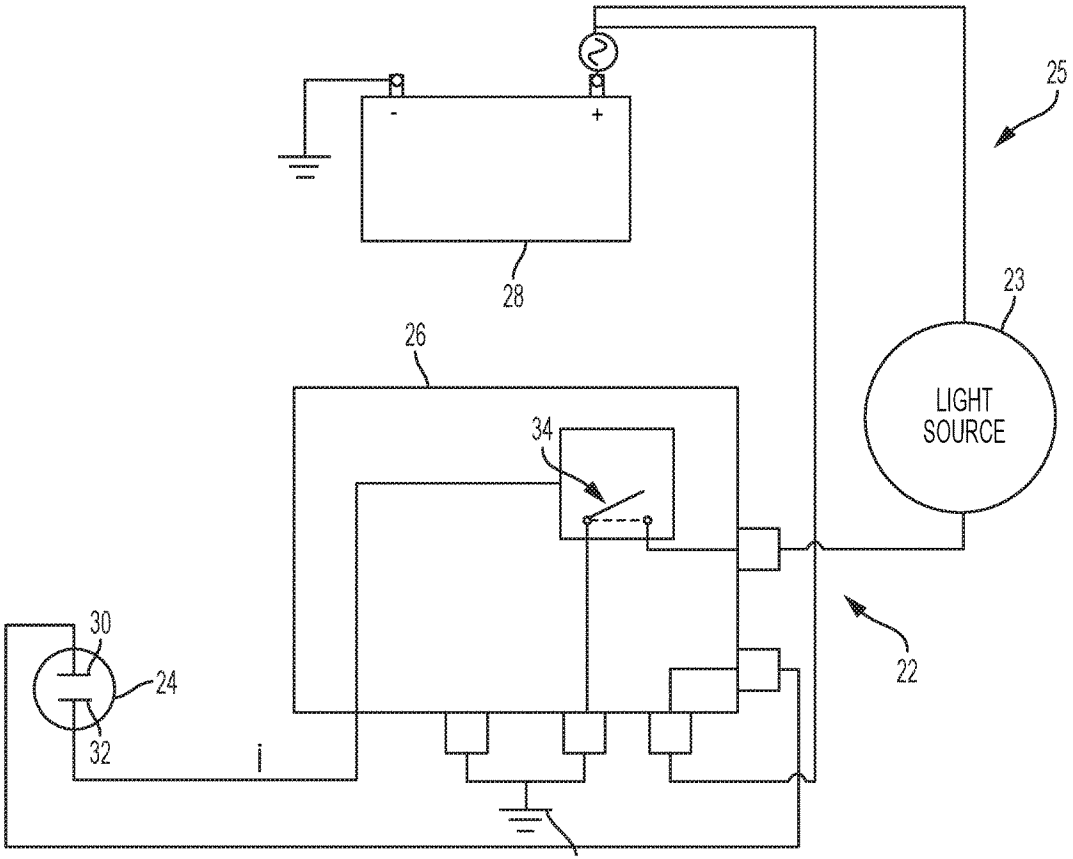
FIG. 3 illustrates an electrical schematic of a water sensor and a light that can be provided on the ladder.

Referring to FIG. 3, one example of an electrical system or circuit 25 for the lighted ladder 16 will be more fully described. As noted herein above, a water sensor 24 can be provided on the ladder 16. The water sensor 24 is electrically connected to a light 22, for example by way of a switching element 26. The switching element 26 is in turn electrically connected to a light source 23 of the light 22. A low voltage power source 28 selectively provides current to each of the switching element 26, the water sensor 24, and the light source 23, as will be described further herein below. In this example, the power source 28 is a battery. The power source 28 could be provided aboard the boat 10 or as part of a packaged assembly with the water sensor 24 and/or the light 22. In one example, the light 22 includes the switching element 26 and the light source 23 (and in some instances the power source 28) mounted together on a circuit board, as will be described herein below.

In the embodiment of the electrical circuit 25 that is shown, the water sensor 24 is a two-wire device with no moving parts and has two probes 30, 32; however, the water sensor 24 could instead be a single probe device. Some examples of suitable water sensors include a two-probe threaded sensor provided by Mercury Marine, part number 889330 S.S. to 8M0021043 (Parker/Racor Filtration part number 10558); a two-probe molded-in-housing sensor provided by Mercury Marine, part number 892242T S.S. to 8M0020346 S.S. to 8M0060042; or a single probe sensor provided by Mercury Marine, part number 828586 S.S. to 828586 1. The probes 30, 32 can, for example, be nickel-gold plated probes. In the embodiments shown, one of the probes 32 is electrically connected to the switching element 26, while the other probe 30 is electrically connected to the power source 28. When no water is present near the water sensor 24, there is relatively little conduction between the two probes 30, 32. However, when water is present near the water sensor 24, current (hereinafter referred to as a "control signal i") is conducted from the probe 30 to the probe 32. The control signal i is input to the switching element 26.

Once a threshold input (which threshold is pre-determined by the specifications of the switching element 26) is provided to the switching element 26, the switching element 26 is activated. For example, the water sensor 24 and switching element 26 can be designed such that the probes 30, 32 must be submerged in water before the switching element 26 will be activated. This can prevent the light source 23 from being illuminated when it is raining or when water splashes onto just one of the two probes 30, 32.

In one embodiment, for example, the switching element 26 comprises a solid state relay and the control signal i activates a coupling mechanism 34 to "close" the normally open switching element 26 and turn the switching element 26 ON. The switching element 26 can be a solid state relay as mentioned, but can alternatively be any type of electronic switching device. For example, the switching element 26 could be an insulated-gate bipolar transistor (IGBT), a MOSFET, or a transistor.

When the water sensor 24 senses the presence of water, the resistance between probes 30 and 32 is reduced, and current is conducted from the power source 28 across the probes 30, 32. The control signal i is thereby provided to the switching element 26, activating and closing the coupling mechanism 34. When the coupling mechanism 34 closes, this provides a connection to ground 36, thereby completing a circuit with the light source 23. Providing current to light source 23 turns on (illuminates) the light source 23. In the examples where the water sensor 24 is connected to more than one light source 23, more than one light source 23 is electrically connected between ground 36 and the power source 28 upon closing of the coupling mechanism 34. The light sources can be connected in parallel so that other light sources are still able to work even if one is burned out. In other examples, redundant water sensors 24 could be provided in electrical connection with the switching element 26, such that conduction between any two probes 30, 32 of any of the redundant water sensors 24 will activate and close the coupling mechanism 34 and illuminate the light source 23.

Figure 4:
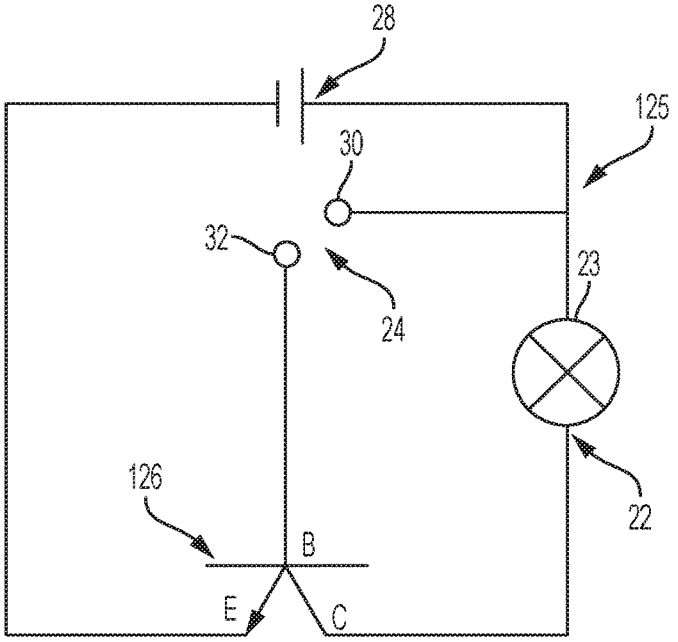
FIG. 4 illustrates another electrical schematic of a water sensor and a light that can be provided on the ladder.

Another example of an electrical circuit 125 for the light 22 is shown in FIG. 4. In this example, the light source 23, water sensor 24, and power source 28 are connected to a switching element 126 such as the NPN transistor shown here. When the probes 30, 32 of the water sensor 24 are immersed in enough water that enough current can be conducted between them to provide a maximum current at the base B of the transistor switching element 126, the transistor switching element 126 is turned on. With both junctions forward-biased, the transistor switching element 126 will be saturated, and current will flow from the collector C to the emitter E, and thus through the light source 23. The light source 23 will therefore be illuminated. Note that other circuits are contemplated, such as a simple series circuit with the light source 23, power source 28, and water sensor 24.

With reference to each of FIGS. 1-4 and 9, the present disclosure is therefore of a ladder 116, 216 for a boat 10, the ladder 116, 216 comprising a rail 18*a*, 18*b*, 218 configured to be coupled to the boat 10. For example, the rails 18*a*, 18*b* of FIG. 2 can be coupled to the boat 10 by way of hooked portions 38*a*, 38*b* at the upper ends of rails 18*a*, 18*b*, which lead to brackets 40*a*, 40*b* that can be attached to the deck of the boat 10. Alternatively, as shown in FIG. 9, the rail 218 may be coupled to the side of the boat 10 by way of a bracket 240. In both examples, a rung 20*a*-20*b*, 220*a*-220*b* is supported by the rail(s) 18*a*, 18*b*, 218. A light source 23 is coupled to at least one of the rung 20*a*-20*b*, 220*a*-220*b* and the rail 18*a*, 18*b*, 218. A power source 28 is configured to provide electrical power to the light source 23. A water sensor 24 (see also 24*a*-24*f*, FIG. 2) is configured to control provision of the electrical power to the light source 23. Electrical power is provided to the light source 23 and the light source 23 is illuminated in response to the water sensor 24 sensing water. In some examples, the ladder 116, 216 includes a plurality of rungs 20*a*-20*b*, 220*a*-220*b* supported by the rail(s) 18*a*, 18*b*, 218. A light source 23, a power source 28, and a water sensor 24 are respectively provided on each rung 20*a*-20*b*, 220*a*-220*b* in the plurality of rungs.

Figure 5A:
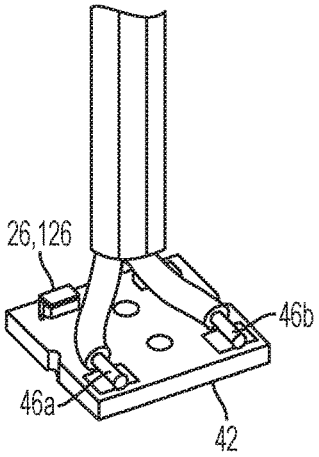
FIGS. 5A and 5B illustrate a printed circuit board for the light according to the present disclosure.
Figure 5B:
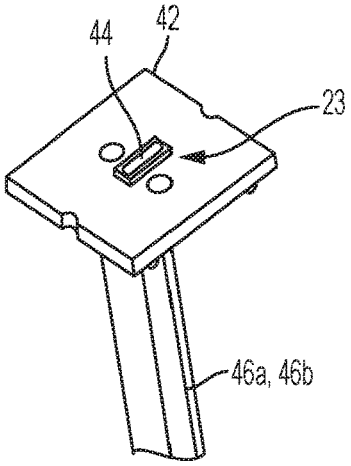

The ladder 116, 216 also includes a switching element 26, 126 that turns ON in response to the water sensor 24 sensing water and thereby completes an electrical circuit 25, 125 with the power source 28 and the light source 23. In one example, as shown in FIGS. 5A and 5B, the ladder 116, 216 includes a printed circuit board (PCB) 42 that supports the light source 23, the switching element 26, 126, and at least portions of the electrical circuit 25, 125. The electrical circuit 25, 125 is not shown on the PCB 42 in FIGS. 5A and 5B, but examples were shown and described with respect to FIGS. 3 and 4. In the example shown herein, the light source 23 is a light-emitting diode (LED) 44; however, other types of light sources 23 could be used, such as incandescent, compact fluorescent, or halogen bulbs. Power from the power source 28 is provided to the elements on the PCB 42 by way of electrical connectors 46*a*, 46*b*. Alternatively, the power source 28 can be provided on the PCB 42 as well.

In any of the above examples, the light source 23, water sensor 24, and power source 28 can be integrated into a given rung 20*a*-20*d*, 220*a*-220*c* of the ladder 116, 216. In another example, the light source 23, water sensor 24, and power source 28 can be integrated into a clip or strip that it fits onto the ladder 16 on the rung 20 and/or the rail 18. The electrical circuit 25, 125 can also be provided with the ability to turn the light 22 on via a separate switch, for example at the top of the ladder 116, 216 or at the helm 14. Alternatively, the assembly of the light source 23, water sensor 24, and power source 28 can be separately enclosed with no elements exposed expect the probes 30, 32, which lessens the chance that water will reach non-probe electrical components in the electrical circuit 25, 125. The light source 23 and/or assembly of the light source 23, water sensor 24, and power source 28 can be silicone-encased or otherwise waterproofed.

Figure 6:
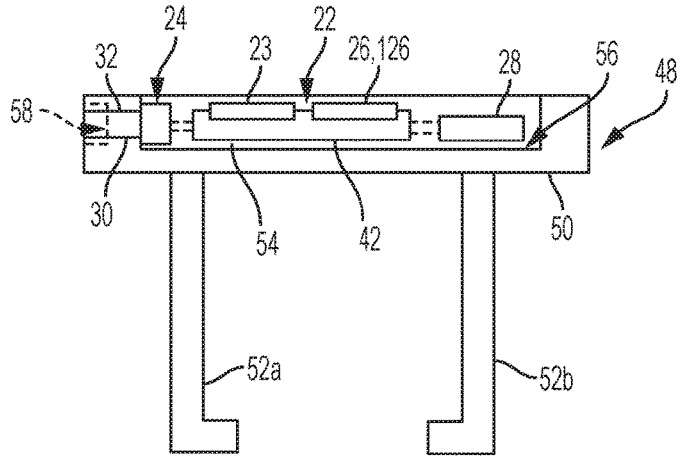
FIG. 6 is a schematic showing a light within a clip for attachment to a ladder.

By way of example, FIG. 6 shows a clip 48 configured to be coupled to the rung 20*a*-20*d*, 220*a*-220*c* or the rail 18*a*, 18*a*, 118 of a ladder 16, wherein the PCB 42 is housed within the clip 48. The clip 48 includes a light housing 50 and two arms 52*a*, 52*b*, which may be made of a plastic that is pliable enough to allow the arms 52*a*, 52*b* to snap around the rung or rail. The PCB 42 is recessed below a top surface of the light housing 50, and includes the switching element 26, 126 and the light source 23. The power source 28 is provided separately from the PCB 42, but still within the light housing 50 of the clip 48. The water sensor 24 is provided in the light housing 50 of the clip 48 as well. A silicone casing 54 covers the PCB 42, the switching element 26, 126, the power source 28, and the light source 23. Except for the two probes 30, 32, which need to be able to make contact with water for the circuit to function properly, the water sensor 24 is also covered by the silicone casing 54. The silicone casing 54 completely fills a hollow 56 in the light housing 50 of the clip 48 so that the top surface of the light housing 50 is flush along its entire length and width. A hollow 58 is also provided in the side of the light housing 50 so that the probes 30, 32 can contact the water without sticking out from the side of the light housing 50, which might otherwise allow them to be damaged. The silicone casing 54 may be clear above the light source 23 and colored or covered with paint or another piece of plastic, a logo sticker, or tape where the switching element 26, 126, power source 28, and water sensor 24 are located.

Figure 7:
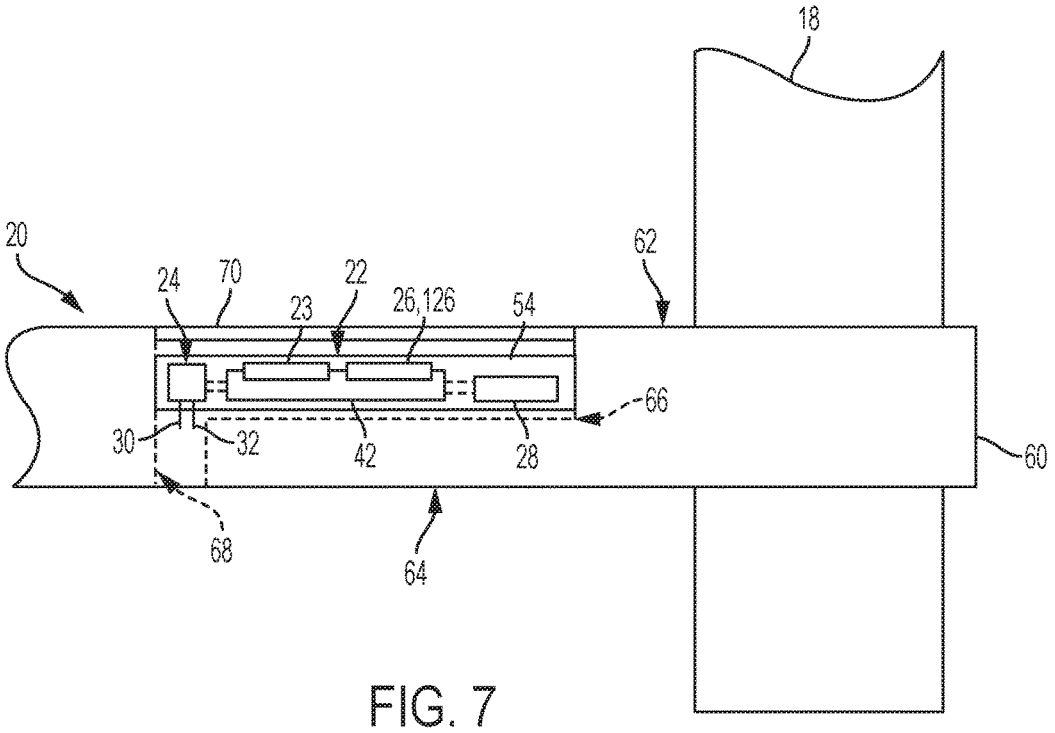
FIG. 7 is a schematic showing a light located within a rung of the ladder.

FIG. 7 shows an example in which the PCB 42 is housed within the rung (generically, 20) of the ladder 16. The rung 20 comprises a main body 60 having a first surface 62 that faces upward when the ladder 16 is in a use position and a second surface 64 that faces downward when the ladder 16 is in the use position. The light source 23 is coupled to the main body 60 of the rung 20, and is recessed from the first surface 62 of the main body 60. More specifically, the PCB 42 (including light source 23 and switching element 26, 126), the power source 28, and all but the ends of probes 30, 32 of the water sensor 24 are housed in a hollow 66 in the first surface 62 of the main body 60. An aperture 68 continues out of the hollow 66 and through to the second surface 64 of the main body 60. The probes 30, 32 of the water sensor 24 extend into the aperture 68, which is open to the water. The silicone casing 54 is molded around all of the above-mentioned light components except the ends of the probes 30, 32. The top surface of the silicone casing 54 may be flush with the first surface 62 of the main body 60 of the rung 20, or, as shown in the present example, a separate plastic cover 70 could be provided that is flush with the first surface 62. The cover 70 could be transparent above the light source 23 only, and opaque above the remainder of the components of the light 22.

Figure 8:
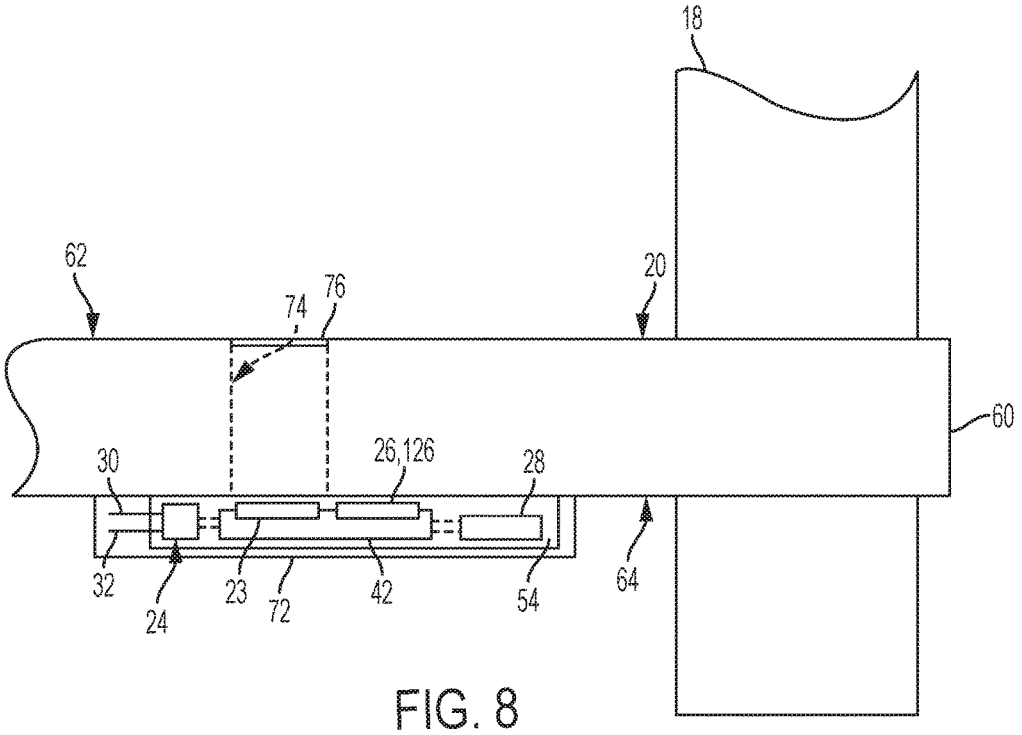
FIG. 8 is a schematic showing a light located within a different portion of the ladder's rung.

FIG. 8 shows another example in which the PCB 42 is housed within the rung 20 of the ladder 16. Here, the main body 60 of the rung 20 has an integral light housing 72 formed on the second surface 64 thereof. The light housing 72 can have any shape that will hold the PCB 42 (including light source 23 and switching element 26, 126), the power source 28, and the water sensor 24. Probes 30, 32 can be provided in a hollow in the light housing 72 that is open to the water. An aperture 74 is provided in the first surface 62 of the main body 60 over the light 22 in such a manner that the light source 23 is aligned with the aperture 74. Light from the light source 23 can therefore be seen through the aperture 74. Although the silicone casing 54 will prevent water from contacting the PCB 42 and other electrical components of the light 22, a plastic cover 76 may be provided over the aperture to prevent water intrusion and provide a flush surface for the user's foot. Alternatively, the aperture 74 could be filled with clear silicone.

In the above examples, the silicone casing 54 may be provided before or after the components of the light 22 and water sensor 24 are assembled within the clip 48 or rung 20. If done before, a mold sized and shaped such that the resulting waterproofed assembly can fit into the respective hollow 56, 66, or light housing 72 can be used. Alternatively, the light 22 and water sensor 24 can be encapsulated in silicone after being assembled into the clip 48 or rung 20. An epoxy can be used in place of a silicone in order to encapsulate and waterproof the components.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A ladder for a boat, the ladder comprising:
a rail configured to be coupled to the boat;
a rung supported by the rail;
a light source coupled to at least one of the rung and the rail;
a power source configured to provide electrical power to the light source; and
a water sensor configured to control provision of the electrical power to the light source;
wherein the electrical power is provided to the light source and the light source is illuminated in response to the water sensor sensing water;
further comprising a switching element that turns ON in response to the water sensor sensing water and thereby completes an electrical circuit with the power source and the light source; and
further comprising a printed circuit board (PCB) that supports the light source, the switching element, and the electrical circuit.

2. The ladder of claim 1, further comprising a silicone casing that covers the PCB, the switching element, the power source, and the light source.

3. The ladder of claim 2, wherein the water sensor comprises two probes.

4. The ladder of claim 3, wherein except for the two probes, the water sensor is also covered by the silicone casing.

5. The ladder of claim 1, wherein the PCB is housed within the rung.

6. The ladder of claim 1, further comprising a clip configured to be coupled to the at least one of the rung and the rail, wherein the PCB is housed within the clip.

7. The ladder of claim 1, wherein the light source is a light-emitting diode (LED).

8. The ladder of claim 1, further comprising:
a plurality of rungs supported by the rail; and
a light source, a power source, and a water sensor respectively provided on each rung in the plurality of rungs.

9. A lighted rung for a boat ladder, the rung comprising:
a main body having a first surface that faces upward when the ladder is in a use position and a second surface that faces downward when the ladder is in the use position;
a light source coupled to the main body;
a power source configured to provide electrical power to the light source; and
a water sensor configured to control provision of the electrical power to the light source;
wherein the electrical power is provided to the light source and the light source is illuminated in response to the water sensor sensing water;
further comprising a switching element that turns ON in response to the water sensor sensing water and thereby completes an electrical circuit with the power source and the light source; and
further comprising a printed circuit board (PCB) that supports the light source, the switching element, and the electrical circuit.

10. The rung of claim 9, further comprising a silicone casing that covers the PCB, the switching element, the power source, and the light source.

11. The rung of claim 10, wherein the water sensor comprises two probes.

12. The rung of claim 11, wherein except for the two probes, the water sensor is also covered by the silicone casing.

13. The rung of claim 9, wherein the PCB is housed within the main body of the rung.

14. The rung of claim 13, further comprising an aperture in the first surface of the main body, wherein the light source is aligned with the aperture such that light from the light source can be seen through the aperture.

15. The rung of claim 14, wherein the light source is recessed from the first surface of the main body.

16. The rung of claim 9, wherein the light source is a light-emitting diode (LED).

17. A ladder for a boat, the ladder comprising:

a rail configured to be coupled to the boat;

a plurality of rungs supported by the rail; and a light source, a power source, and a water sensor respectively provided on each rung in the plurality of rungs;

wherein, on each rung, the power source is configured to provide electrical power to the light source;

wherein, on each rung, the water sensor is configured to control provision of the electrical power from the power source to the light source; and wherein, on each rung, the electrical power is provided to the light source and the light source is illuminated in response to the water sensor sensing water.

18. The ladder of claim 17, further comprising, on each rung, a switching element that turns ON in response to the water sensor sensing water and thereby completes an electrical circuit with the power source and the light source.

19. The ladder of claim 18, further comprising, on each rung, a printed circuit board (PCB) that supports the light source, the switching element, and the electrical circuit.

20. The ladder of claim 19, further comprising, on each rung, a silicone casing that covers the PCB, the switching element, the power source, and the light source.

* * * * *